US008020620B2

(12) United States Patent
Daniels et al.

(10) Patent No.: US 8,020,620 B2
(45) **Date of Patent: *Sep. 20, 2011**

(54) METHODS OF PRODUCING FLOW-THROUGH PASSAGES IN CASING, AND METHODS OF USING SUCH CASING

(75) Inventors: John Daniels, Oklahoma City, OK (US); George Waters, Oklahoma City, OK (US); Mark Norris, Cults (GB); J. Ernest Brown, Cambridge (GB); Ian D. Bryant, Houston, TX (US); Kevin Mauth, Kingwood, TX (US); Jason Swaren, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/878,498

(22) Filed: Sep. 9, 2010

(65) Prior Publication Data

US 2011/0005754 A1 Jan. 13, 2011

Related U.S. Application Data

(63) Continuation of application No. 11/769,284, filed on Jun. 27, 2007, now Pat. No. 7,810,567.

(51) Int. Cl.
*E21B 43/10* (2006.01)
*E21B 29/02* (2006.01)

(52) U.S. Cl. ..... 166/297; 166/300; 166/376

(58) Field of Classification Search ..... None
See application file for complete search history.

(56) References Cited

U.S. PATENT DOCUMENTS

| | | | | |
|---|---|---|---|---|
| 4,232,741 | A * | 11/1980 | Richardson et al. | 166/281 |
| 5,355,956 | A * | 10/1994 | Restarick | 166/296 |
| 6,253,851 | B1 * | 7/2001 | Schroeder et al. | 166/278 |
| 2008/0142219 | A1 * | 6/2008 | Steele et al. | 166/281 |
| 2008/0196896 | A1 * | 8/2008 | Bustos et al. | 166/281 |

* cited by examiner

*Primary Examiner* — Zakiya W Bates
(74) *Attorney, Agent, or Firm* — Michael Dae; David Cate; Robin Nava

(57) ABSTRACT

Methods of making and using wellbore casing are described, one method comprising providing a plurality of flow-through passages in a portion of a casing while the casing is out of hole; temporarily plugging the flow-through passages with a composition while out of hole; running the casing in hole in a wellbore intersecting a hydrocarbon-bearing formation; and exposing the composition to conditions sufficient to displace the composition from the flow-through passages while in hole. Methods of using the casing may include pumping a stimulation treatment fluid through the casing string and into a formation through the flow-through passages in the first casing joint; plugging the flow-through passages in the first casing section; and exposing a second casing joint of the casing string to conditions sufficient to displace the composition from the flow-through passages in the second casing joint.

20 Claims, 4 Drawing Sheets

METHODS OF PRODUCING FLOW-THROUGH PASSAGES IN CASING, AND METHODS OF USING SUCH CASING

This application claims priority as a continuation application of U.S. patent application Ser. No. 11/769,284, entitled, "Methods of Producing Flow-Through Passages in Casing, and Methods of Using Such Casing," filed Jun. 27, 2007, now U.S. Pat. No. 7,810,567 and incorporated by reference herein in its entirety.

BACKGROUND OF THE INVENTION

1. Field of Invention

The present invention relates generally to the field of oilfield exploration, production, and testing, and more specifically to casing and casing joints useful in such operations.

2. Related Art

In hydrocarbon production, after a well has been drilled and casing has been cemented in the well, perforations are created to allow communication of fluids between reservoirs in the formation and the wellbore. Any suitable perforating techniques recognized in the industry may be used. Shaped charge perforating is commonly used, in which shaped charges are mounted in perforating guns that are conveyed into the well on a slickline, wireline, tubing, or another type of carrier. The perforating guns are then fired to create openings in the casing and to extend perforations as penetrations into the formation. In some cases wells may include a pre-pack comprising an oxidizer composition, and perforation may proceed through the pre-pack. These techniques may be used separately or in conjunction with shaped charges that include an oxidizer in the charge itself. Any type of perforating gun may be used. A first type, as an example, is a strip gun that includes a strip carrier on which capsule shaped charges may be mounted. The capsule shaped charges are contained in sealed capsules to protect the shaped charges from the well environment. Another type of gun is a sealed hollow carrier gun, which includes a hollow carrier in which non-capsule shaped charges may be mounted. The shaped charges may be mounted on a loading tube or a strip inside the hollow carrier. Thinned areas (referred to as recesses) may be formed in the wall of the hollow carrier housing to allow easier penetration by perforating jets from fired shaped charges. Another type of gun is a sealed hollow carrier shot-by-shot gun, which includes a plurality of hollow carrier gun segments in each of which one non-capsule shaped charge may be mounted.

Other downhole perforating mechanisms are described generally in U.S. Pat. No. 6,543,538. Alternative perforating devices include water and/or abrasive jet perforating, chemical dissolution, and laser perforating for the purpose of creating a flow path between the wellbore and the surrounding formation. There are many disadvantages to current perforating techniques. As explained in this patent, not only is a perforating device required downhole, in many cases an actuating device must be suspended in the wellbore for the purpose of actuating the charges or other devices that may be conveyed by the casing. Each individual gun may be on the order of 2 to 8 feet in length, and contain on the order of 8 to 20 perforating charges placed along the gun tube; as many as 15 to 20 individual guns could be stacked one on top of another such that the assembled gun system total length may be approximately 80 to 100 feet. This total gun length must be deployed in the wellbore using a surface crane and lubricator systems. Longer gun lengths could also be used, but would generally require additional or special equipment. The perforating device must be conveyed downhole by various means, such as electric line, wireline, slickline, conventional tubing, coiled tubing, and casing conveyed systems. The perforating device can remain in the hole after perforating the first zone and then be positioned to the next zone before, during, or after treatment of the first zone. There are numerous other patents describing perforating, but they all require either a mechanical device (such as a sliding sleeve), pumping fluid though a jetting device, perforating guns, or other downhole devices.

In sum there are many disadvantages in conventional perforating techniques, including: safety concerns with explosive charges; the need for conveying equipment to convey the perforating device and actuators, if any, downhole; risk of loss or damage of these devices downhole; time required in deploying the mechanisms downhole. Further, while it is possible to perforate casing downhole at one well location and then move the perforating device within the wellbore to another location and repeat the perforation process, there is the possibility for erring in locating the perforating device, which is disadvantageous. Nevertheless, and despite these and other disadvantages, these downhole perforating techniques are the standard today. There is a need in the art to eliminate or reduce risks, cost, and time of conventional perforating.

SUMMARY OF THE INVENTION

In accordance with the present invention, methods of making casing having a plurality of temporarily plugged flow-through passages and methods of using same are described that reduce or overcome problems in previously known methods of perforating casing and treatment of wellbores.

A first aspect of the invention are methods comprising:

(a) providing a plurality of flow-through passages in a portion of a casing while the casing is out of hole;
(b) temporarily plugging the flow-through passages with a composition while out of hole;
(c) running the casing in hole; and
(d) exposing the composition to conditions sufficient to displace the composition from the flow-through passages while in hole.

Another aspect of the invention are methods of using casing sections made in accordance with the first aspect of the invention in performing an oilfield operation, such as fracturing and acidizing, one method comprising:

(a) providing a plurality of casing sections and a plurality of casing joints for joining the casing sections, the casing joints having a plurality of flow-through passages therethrough temporarily plugged with a composition, the composition independently selected for each casing joint;
(b) forming a casing string comprising the casing sections and casing joints and running the casing string in hole;
(c) exposing a first casing joint of the casing string to conditions sufficient to displace the composition from the flow-through passages in the first casing joint;
(d) pumping a stimulation treatment fluid into a formation through the flow-through passages in the first casing joint;
(e) plugging the flow-through passages in the first casing section; and
(f) exposing a second casing joint of the casing string to conditions sufficient to displace the composition from the flow-through passages in the second casing joint.

Methods of this aspect may be repeated multiple times for as many zones that need to be treated. According to the invention, multiple zones may be treated in any suitable order, or even concurrently. In some embodiments the lowest or most distal zone from the surface is first treated, and subsequent zone treatments are moved upward or near the surface, sequentially. Also, methods of the invention, in some instance, use the flow through passages for treatment, only some of flow through passages are used while others blocked, or no flow through passages are used. Also, flow through passages, or the casing may be blocked by any suitable means readily known, such as a ball sealer, or ball sealer in combination with a seat.

Some method embodiments of the invention involve diversion techniques. Diversion may be used in injection treatments, such as, but not limited to, matrix stimulation, to ensure a uniform distribution of treatment fluid across the treatment interval. Injected fluids tend to follow the path of least resistance, possibly resulting in the least permeable areas receiving inadequate treatment. By using some means of diversion, the treatment can be focused on the areas requiring the most treatment. In some aspects, the diversion effect is temporary to enable the full productivity of the well to be restored when the treatment is complete. The diversion technique may be chemical diversion, mechanical diversion, or combination of both.

The flow-through passages may be formed by any known techniques, such as cutting, sawing, drilling, filing, and the like, these methods not being a part of the invention per se. The process of forming the flow-through passages may be manual, automated, or combination thereof. The dimensions and shapes of the flow-through passages may be any number of sizes and shapes, such as circular, oval, rectangular, rectangular with half circles on each end, slots, including slots angled to the longitudinal axis of the casing, and the like. The flow-through passages may surround the casing or casing joint in 60 degree (or other angle) phasing. The phasing may be 5, 10, 20, 30, 60, 75, 90, 120 degree phasing. In certain embodiments it may be desired to maximize the Area Open to Flow (AOF), in which case rectangular flow-through passages may be the best choice; however, these shapes may be more difficult to manufacture, and may present problems with mechanical strength of the pup joint. Circular flow-through passages would be easiest to make, but these sacrifice AOF due to the casing curvature. Slots and notches may be used in certain embodiments and allow covering the "weep hole" formed by pulsation of tubing while sand jetting. The slots in the casing, if used, could also be at an angle to the casing (not longitudinal with it). In certain embodiments, from 4 to 6 angled slots at the same depth around the casing may be used. In this way we would be more likely to get an opening in the casing that would align with the frac plane.

Regarding the composition to temporarily fill the flow-through passages, these may be inorganic materials, organic materials, mixtures of organic and inorganic, and the like. As used herein the term "filling" the flow-through passages may include a soluble "patch" over the flow-through passages (on inside or outside surface of the pipe). Non-limiting examples of compositions that may be dissolved by acid include materials selected from magnesium, aluminum, and the like. Reactive metals, earth metals, composites, ceramics, and the like may also be used. The composition should be able to hold pressure up to an absolute pressure of about 6,000 psi [41 megapascals], in certain embodiments up to about 7,000 psi [48 megapascals], in other embodiments up to about 8,000 psi [55 megapascals], in certain embodiments up to about 9,000 psi [62 megapascals], and in certain embodiments up to about 10,000 psi [68 megapascals].

The various aspects of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
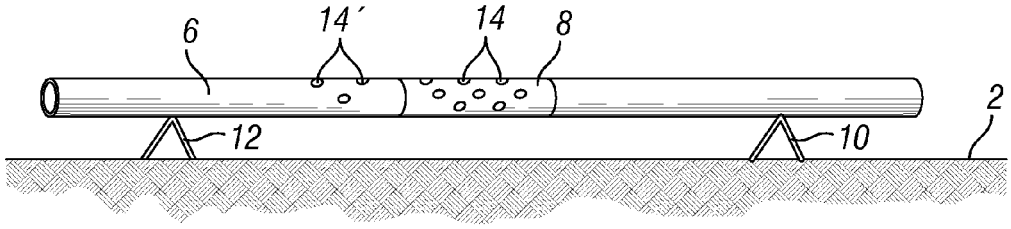
FIG. 1 illustrates schematically two pipe sections joined together by a casing joint on the surface to form a casing string, into which is provided a plurality of flow-though passages.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the various aspects of the present invention may be practiced without these details and that numerous variations or modifications from the described embodiments may be possible.

Described herein are methods of providing flow-through passages in casing and/or casing joints, temporarily plugging the flow-through passages, inserting the casing string into a wellbore intersecting a subterranean hydrocarbon formation, subsequently unplugging the flow-through passages, and treating a formation with a fluid or other material through the flow-through passages. Unique to the present invention, the flow-through passages and plugging of same are made at the surface, prior to inserting the casing string into the wellbore. As used herein the terms "hydrocarbon formation", sometimes referred simply to as a "formation", includes land based (surface and sub-surface) and sub-seabed applications, and in certain instances seawater applications, such as when exploration, drilling, or production equipment is deployed through seawater. The terms include oil and gas formations or portions of formations where oil and gas are expected but may ultimately only contain water, brine, or some other composition.

As used herein the terms "out of hole" and "in hole" have their commonly used meanings in the hydrocarbon production field. When a process or process step is performed "out of hole", this means at the Earth's and when a process or process step is performed "in hole", the process or process step is performed downhole in the wellbore, and in certain embodiments is carried out in a location where a fluid may be deployed into or withdrawn from a subterranean formation. In certain methods, a plurality of flow-through passages may be made in one or more joint sections of casing, and in certain of these methods the running in hole may comprise running in hole a casing string comprising a plurality of casing sections joined together by a plurality of casing joint sections.

"Composition" as used herein includes organic materials, inorganic materials, and mixtures and reacted combinations thereof. The materials may be natural, synthetic, and combinations thereof, including natural and synthetic polymeric materials. "Plugging" as used herein includes fully or partially filling in a flow-through passage so that no fluid may traverse through the flow-through passage, and may also simply comprise placing a seal on the outside or inside surface of the casing over the flow-through passage so that no fluid may traverse through the flow-through passage. A soluble inner or outer sleeve may be used. Combinations of these options may be used, for example, an inner seal in conjunction with a material filling the flow-through passage. Other alternatives will be apparent to those skilled in the art. In any case the plugging must be "temporary" in the sense that one or more activators may be used to unplug the flow-through passages when desired.

In general, methods of the invention comprise displacing the composition from the flow-through passages by an activator which may be physical, chemical, mechanical, radiational, thermal or combination thereof. For example the activator may be selected from change in temperature, change in composition (such as a change in pH), change in abrasiveness, change in force or pressure exerted on the composition (i.e. hydraulic pressure), exposure to particle radiation, exposure to non-particle radiation, and combinations of two or more of these. When two or more activators are employed, the exposure may occur sequentially, simultaneously, or overlapping in time. The composition may be, for example, an acid-soluble composition, and the exposing step may comprise deploying an acid solution from the surface in hole. In other methods, the exposing step may comprise spotting an acid solution using coiled tubing. Non-particle radiation may be spotted downhole through use of optical fibers, for example. Heat and cold may be provided in any number of ways, such as through electrical heating elements, coiled tubing through which flows a hot or cold fluid (relative to the composition), and the like.

FIG. 1 illustrates schematically two pipe sections 4, 6 joined together by a casing joint 8, sometimes referred to as a pup joint, to form a casing string, into which is provided a plurality of flow-though passages 14 randomly distributed about the circumference of casing joint 8. Flow-though passages 14 may be positioned randomly, or non-randomly (in definite pattern). Flow-through passages may also be formed in the casing itself, as noted at 14'. For the purpose of simplifying the discussion, we will discuss primarily flow-through passages 14 in the casing joint, it being understood that flow-through passages 14' may comprise the same or similar features. Note that FIG. 1 illustrates the casing string on the surface of the earth 2, supported by supports 10, 12. Flow-through passages 14 and/or 14' are formed in the casing joint 8 and/or casing pipes 4, 6 while they are on or at the earth's surface, in other words out of hole. The flow-through passages may be formed before or after the string is assembled. As mentioned previously, the methods of making the flow-through passages is not a critical feature of the invention, but methods may be mentioned, such as cutting, sawing, drilling, filing, and the like, and these process may be automated, such as through computer-aided machining.

Figure 2:
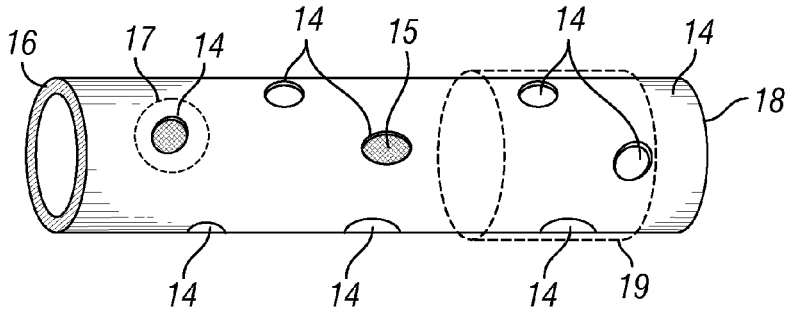
FIG. 2 illustrates schematically the casing joint of FIG. 1, illustrating a plurality of flow-through passages, one of which is plugged with a composition in accordance with the invention.

FIG. 2 illustrates schematically in perspective view the casing joint of FIG. 1, illustrating a plurality of flow-through passages 14, one of which is temporarily plugged with a composition 15 in accordance with the invention. Flow-through passages 14 are illustrated as circular, but this is not necessary to the invention. Also illustrated are some alternatives within the invention for restricting flow through the flow-through passages. For example, a soluble or otherwise degradable internal patch 17 may be positioned on the inside surface of casing joint 8. Another alternative may be a degradable sleeve 19 positioned temporarily over the external surface of the casing joint. Ends 16, 18 of casing joint 8 may be fastened to the casing pipe (not illustrated) in any manner, including those typically used in the tubular goods industry, including welding, screwed fittings, flanged, and the like.

Figure 3:
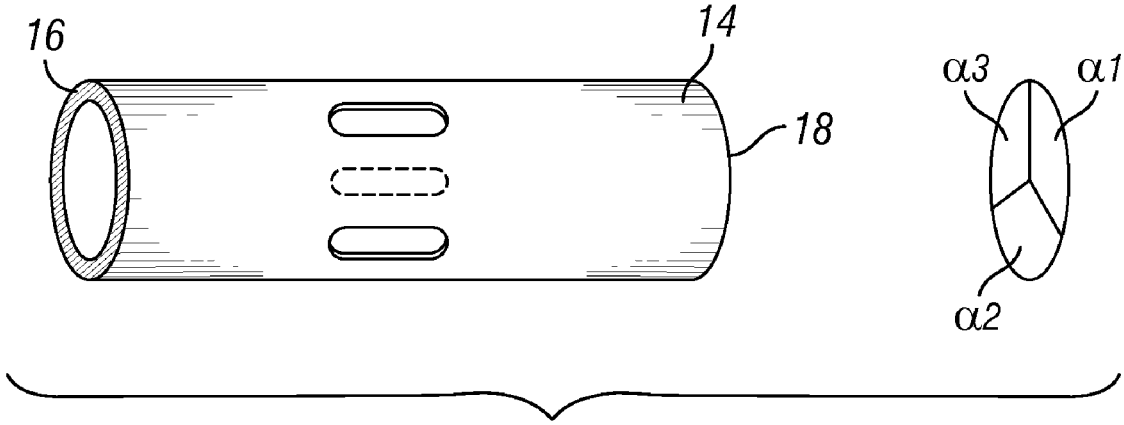
FIGS. 3 and 4 illustrate other casing joints having other shaped flow-though passages useful in the invention.
Figure 4:
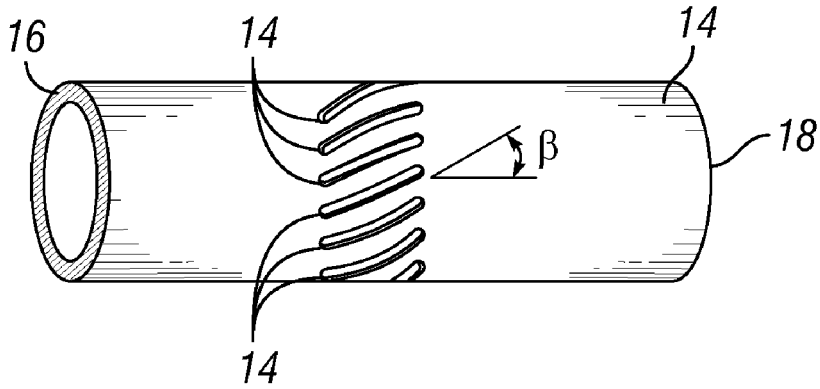

FIGS. 3 and 4 illustrate perspective views of other casing joints having other shaped flow-though passages useful in the invention. FIG. 3 illustrates three rectangular slots 14*a*, 14*b*, and 14*c*, each having rounded ends. The three slots 14*a*, 14*b*, and 14*c* are positioned at equal angles $\alpha$1, $\alpha$2, and $\alpha$3 about the casing joint, each angle being 120 degrees, as illustrated. The angle $\alpha$ mat be optimized for the strength requirement for the casing joint, and, in some embodiments, may range from about 45 degrees (in embodiments having 8 flow-through passages) to about 180 degrees (in embodiments having two flow-through passages). Those skilled in the art will realize that more flow-through passages may mean that the casing or casing joint may not be as strong in the area of the flow-through passages as a casing or casing joint having less flow-through passages, and will be able to adjust the number and the angle $\alpha$ accordingly. FIG. 4 illustrates yet another alternative, having a plurality of angled slots 14. In this embodiment each slot is positioned at an angle of $\beta$ with respect to the longitudinal axis of the casing joint. The angle $\beta$ also somewhat depends on the strength requirements of the casing joint, but may range from 0 degrees up to about 45 degrees.

Figure 5C:
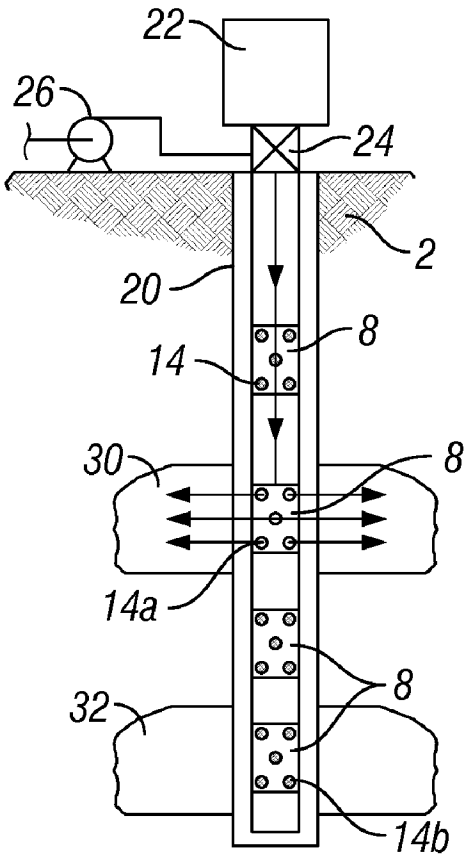
FIGS. 5A-F, are schematic side elevation views of a wellbore cased with a casing in accordance with the invention, illustrating a method of the invention.
Figure 5B:
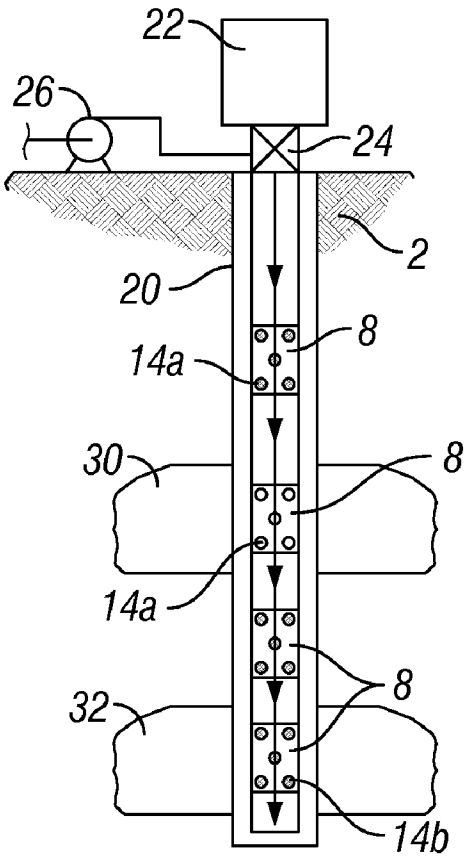
Figure 5A:
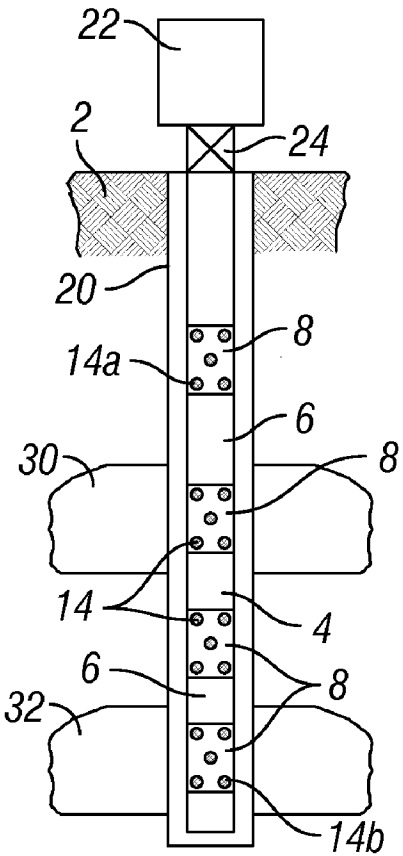
Figure 5F:
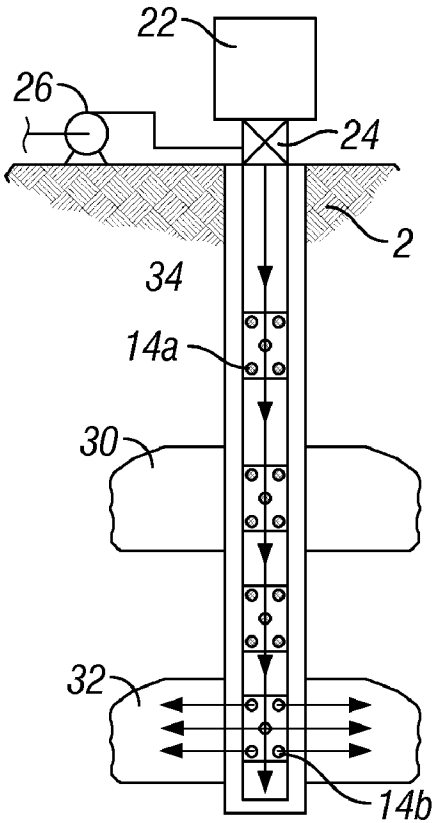
Figure 5E:
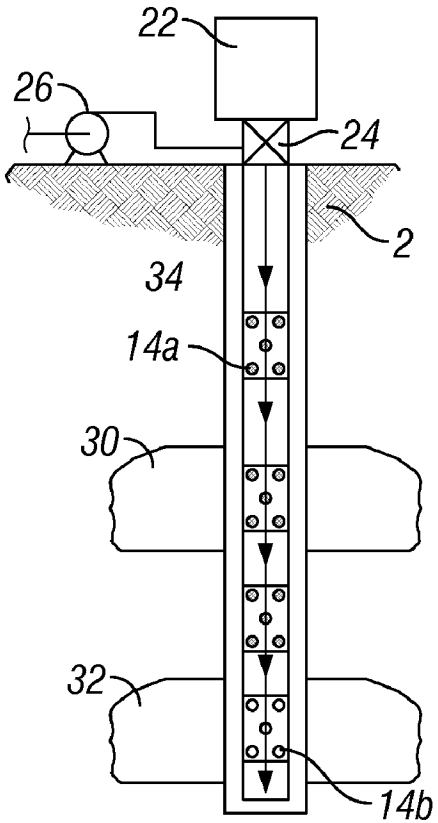
Figure 5D:
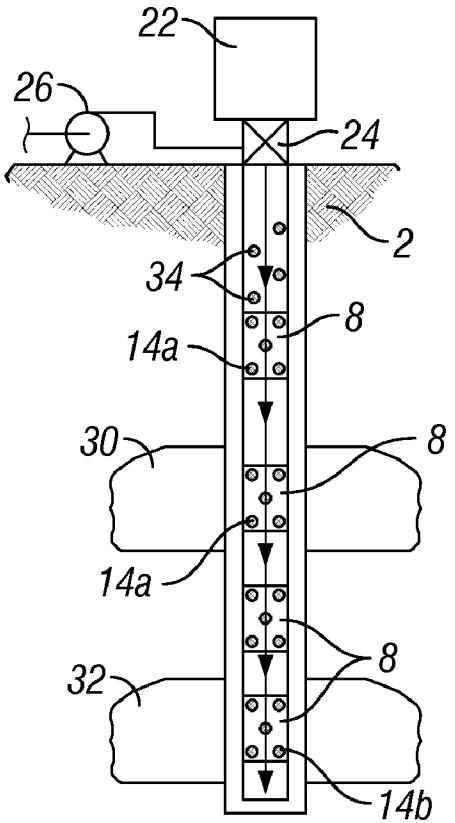

FIGS. 5A-F, are schematic side elevation views of a wellbore cased with a casing designed in accordance with the invention, illustrating a method of the invention. FIGS. 5A-F all illustrate a casing string comprising casing sections 4 and 6 linked together by casing sections 8 each having a plurality of temporarily plugged flow-through passages 14 therein. The casing string has been placed in a well bore 20 which intersects hydrocarbon fluid pay zones 30 and 32. FIGS. 5A-F all also illustrate schematically a wellhead 22 and wellhead valve 24, and FIGS. 5B-F illustrate a surface pump 26. Those skilled in the art will understand that many configurations of wellbores, wellheads, valves, and pumps are possible, and this document need not go into detail on those well-known features. As illustrated schematically in FIG. 5A, all of the flow-through passages are initially temporarily plugged with a composition susceptible to attack. The composition may be the same or different from one casing joint to the next casing joint, or different even within the same casing joint. Turning to FIG. 2, pump 26 has pumped a fluid downhole through the casing string which has one or more parameters allowing it to dissolve or otherwise degrade composition within flow-through passages 14*a* near pay zone 30. FIG. 5C illustrates pump 26 subsequently pumping a treatment fluid down hole through the casing string under pressure sufficient to treat pay zone 30. Note that composition in flow-through passages 14*b* near pay zone 32 remain intact. Turning to FIG. 5D, pump 26 (or another pump) is illustrated pumping a fluid down hole through the casing string that includes a composition 24 able to plug flow-through passages 14*a*, while not affecting any of the other compositions temporarily plugging flow-through passages 14 in other casing joints 8. FIG. 5E illustrates a subsequent step whereby another fluid composition is delivered down hole through the casing string by pump 26 to dissolve or otherwise degrade the composition temporarily filling flow-through passages 14*b*, while leaving the compositions in the other flow-through passages 14*a* intact. FIG. 5F illustrates pump 26 delivering another fluid composition down hole through the casing string to treat hydrocarbon pay zone 32 through flow-through passages 14*b*. Those skilled in the art will realize many different scenarios, methods and equipment that may be used to achieve these results, after having the benefit of this disclosure. For example, one skilled in the art may decide that using coiled tubing to spot certain compositions down hole would be a better option. Also, those in the art would realize that the scenario described in FIGS. 5A-F may also apply to deviated wellbores, such as a horizontal wellbore, or any non-vertical deviated wellbore. These variations are deemed within the generic concept of the invention.

The composition may comprise acid-, basic-, and/or water-soluble polymers, with or without inclusion of relatively insoluble materials, such as water-insoluble polymers, ceramics, fillers, and combinations thereof. Aluminum and magnesium bolts or plugs are one example of acid-soluble inorganic materials. Compositions useful in the invention may comprise a water-soluble inorganic material, a water-soluble organic material, and combinations thereof. The water-soluble organic material may comprise a water-soluble polymeric material, for example, but not limited to poly(vinyl alcohol), poly(lactic acid), and the like. The water-soluble polymeric material may either be a normally water-insoluble polymer that is made soluble by hydrolysis of side chains, or the main polymeric chain may be hydrolysable.

The composition functions to dissolve when exposed in a user controlled fashion to one or more activators. In this way, zones in a wellbore, or the wellbore itself or branches of the wellbore, may be treated for periods of time uniquely defined by the user. The casings modified in accordance with the invention may be used to deliver controlled amounts of chemicals, heat, light, pressure or some other activator or combination of activators useful in a variety of well treatment operations.

If the activator is a fluid composition, compositions useful in the invention include water-soluble materials selected from water-soluble inorganic materials, water-soluble organic materials, and combinations thereof. Suitable water-soluble organic materials may be water-soluble natural or synthetic polymers or gels. The water-soluble polymer may be derived from a water-insoluble polymer made soluble by main chain hydrolysis, side chain hydrolysis, or combination thereof, when exposed to a weakly acidic environment. Furthermore, the term "water-soluble" may have a pH characteristic, depending upon the particular polymer used.

In some embodiments, suitable water-insoluble polymers which may be made water-soluble by acid hydrolysis of side chains include those selected from polyacrylates, polyacetates, and the like and combinations thereof.

Suitable water-soluble polymers or gels include those selected from polyvinyls, polyacrylics, polyhydroxyacids, and the like, and combinations thereof.

Suitable polyvinyls include polyvinyl alcohol, polyvinyl butyral, polyvinyl formal, and the like, and combinations thereof. Polyvinyl alcohol is available from Celanese Chemicals, Dallas, Tex., under the trade designation Celvol. Individual Celvol polyvinyl alcohol grades vary in molecular weight and degree of hydrolysis. Molecular weight is generally expressed in terms of solution viscosity. The viscosities are classified as ultra low, low, medium and high, while degree of hydrolysis is commonly denoted as super, fully, intermediate and partially hydrolyzed. A wide range of standard grades is available, as well as several specialty grades, including polyvinyl alcohol for emulsion polymerization, fine particle size and tackified grades. Celvol 805, 823 and 840 polyvinyl alcohols are improved versions of standard polymerization grades—Celvol 205, 523 and 540 polyvinyl alcohols, respectively. These products offer a number of advantages in emulsion polymerization applications including improved water solubility and lower foaming. Polyvinyl butyral is available from Solutia Inc. St. Louis, Mo., under the trade designation BUTVAR. One form is Butvar Dispersion BR resin, which is a stable dispersion of plasticized polyvinyl butyral in water. The plasticizer level is at 40 parts per 100 parts of resin. The dispersion is maintained by keeping pH above 8.0, and may be coagulated by dropping the pH below this value. Exposing the coagulated version to pH above 8.0 would allow the composition to disperse, thus affording a control mechanism.

Suitable polyacrylics include polyacrylamides and the like and combinations thereof, such as N,N-disubstituted polyacrylamides, and N,N-disubstituted polymethacrylamides. A detailed description of physico-chemical properties of some of these polymers are given in, "Water-Soluble Synthetic Polymers: Properties and Behavior", Philip Molyneux, Vol. I, CRC Press, (1983) incorporated herein by reference.

Suitable polyhydroxyacids may be selected from polyacrylic acid, polyalkylacrylic acids, interpolymers of acrylamide/acrylic acid/methacrylic acid, combinations thereof, and the like.

When a fluid having, a specific, controlled pH and temperature is pumped into the well, the composition in the plugged flow-through passages will be exposed to the fluid and begin to degrade, depending on the composition and the fluid chosen. The degradation may be controlled in time to degrade quickly, for example over a few seconds or minutes, or over longer periods of time, such as hours or days. For example, a composition useful in the invention that dissolves at a temperature above reservoir temperature may be used to plug the flow-through passages, and subsequently exposed to a fluid pumped from the surface having a temperature above the reservoir temperature. The reverse may be desirable in other well treatment operations. The composition plugging the flow-through passages may then be allowed to warm up to the pumped fluid temperature at the layer where treatment is taking place, allowing degradation of the composition. When the treatment operation is desired at another layer of the formation, another set of flow-through passages plugged with another composition may be exposed to an even warmer temperature, thus enabling the composition in these flow-through passages to degrade. No special intervention is needed to remove the dissolved compositions after their useful life of temporarily plugging the flow-through passages is completed, due to the small amount of composition present. In most embodiments the composition will simply be removed with production from the well.

Compositions useful in the invention may comprise a first component and a second component as described in assignee's co-pending published US application number 20070044958, published Mar. 1, 2007, incorporated herein by reference. In these compositions, the first component functions to limit dissolution of the second component by limiting either the rate, location (i.e., front, back, center or some other location of the element), or both rate and location of dissolution of the second material. The first component may also serve to distribute loads at high stress areas, such as at a seat of the composition in a flow-through passage. Also, the first component may have a wider temperature characteristic compared to the more soluble second component such that it is not subject to excessive degradation at extreme temperature by comparison. The first component may be structured in many ways to control degradation of the second component. For example, the first component may comprise a coating, covering, or sheath upon a portion of or an entire outer surface of the second component, or the first component many comprise one or more elements embedded into a mass of the second component. The first component may comprise a shape and a composition allowing the first component to be brought outside of the wellbore by a flowing fluid, such as by pumping, or by reservoir pressure. The first component may be selected from polymeric materials, metals that do not melt in wellbore environments, materials soluble in acidic compositions, frangible ceramic materials, and composites. The first component may include fillers and other ingredients as long as those ingredients are degradable by similar mechanisms. Suitable polymeric materials for the first composition include natural polymers, synthetic polymers, blends of natural and synthetic polymers, and layered versions of polymers, wherein individual layers may be the same or different in composition and thickness. The term "polymeric material" includes composite polymeric materials, such as, but not limited to, polymeric materials having fillers, plasticizers, and fibers therein. Suitable synthetic polymeric materials include those selected from thermoset polymers and non-thermoset polymers. Examples of suitable non-thermoset polymers include thermoplastic polymers, such as polyolefins, polytetrafluoroethylene, polychlorotrifluoroethylene, and thermoplastic elastomers.

Materials susceptible to attack by strongly acidic compositions may be useful materials in the first component, as long as they can be used in the well environment for at least the time required to divert fracturing fluids. Ionomers, polyamides, polyolefins, and polycarbonates, for example, may be attacked by strong oxidizing acids, but are relatively inert to weak acids. Depending on the chemical composition and shape of the first material, its thickness, the temperature in the wellbore, and the composition of the well and injected fluids, including the pH, the rate of decomposition of the first component may be controlled.

The second component functions to dissolve when exposed to the wellbore conditions in a user controlled fashion, i.e., at a rate and location controlled by the structure of the first component. In this way, zones in a wellbore, or the wellbore itself or branches of the wellbore, may be treated for periods of time uniquely defined by the user. The second component may comprise a water-soluble inorganic material, a water-soluble organic material, and combinations thereof, as previously described herein. Compositions of this nature will generally have first and second ends that may be tapered in shape to contribute to the ease of the composition being placed in the flow-through passages. The first and second components may or may not have the same basic shape. For example, if the first component comprises a coating, covering, or sheath entirely covering the second component, the shapes of the first and second components will be very similar. In these embodiments, the first component may comprise one or more passages to allow well fluids or injected fluids to contact the second component. Since the diameter, length, and shape of the passages through the first component are controllable, the rate of dissolution of the second component may be controlled solely by mechanical manipulation of the passages. In addition, the one or more passages may extend into the second component a variable distance, diameter, and/or shape as desired to control the rate of dissolution of the second component. The rate of dissolution is also controllable chemically by choice of composition of the second material. The composition may comprise a structure wherein the first component comprises a plurality of strips of the first material embedded in an outer surface of the second component, or some other shaped element embedded into the second component, such as a collet embedded in the second component. In other compositions useful in the invention, the first component may comprise a plurality of strips or other shapes of the first component adhered to an outer surface of the second component.

Polymeric materials susceptible to attack by strongly acidic compositions may be useful compositions for temporarily plugging flow-through passages, as long as they can be degraded when desired. Ionomers, polyamides, polyolefins, and polycarbonates, for example, may be attacked by strong oxidizing acids, but are relatively inert to weak acids. Depending on the chemical composition, flow rate, mechanical properties or other considerations of the activator, the rate of decomposition of the composition may be controlled.

Alternatively, temporary plugging may be achieved using a composition formed of mechanical elements, for example as a burst disk assembly, such as those described in U.S. Pat. No. 7,096,954, Boney et al., the contents of which are incorporated herein by reference thereto. Plugging mechanisms may also include a range of items from ball sealers (to plug holes), casing flapper valves, or even balls dropped from surface to land on casing seats.

Frangible ceramic materials may be useful compositions for temporarily plugging the flow-through passages, including chemically strengthened ceramics of the type known as "Pyroceram" marketed by Corning Glass Works of Corning, N.Y. and used for ceramic stove tops. This material is made by replacing lighter sodium ions with heavier potassium ions in a hardening bath, resulting in pre-stressed compression on the surface (up to about 0.010 inch thickness) and tension on the inner part. One example of how this is done is set forth in U.S. Pat. No. 2,779,136, assigned to Corning Glass Works. As explained in U.S. Pat. No. 3,938,764, assigned to McDonnell Douglas Corporation, such material normally had been used for anti-chipping purposes such as in coating surfaces of appliances, however, it was discovered that upon impact of a highly concentrated load at any point with a force sufficient to penetrate the surface compression layer, the frangible ceramic will break instantaneously and completely into small pieces over the entire part. If a frangible ceramic is used for temporarily plugging flow-through passages, a coating or coatings such as described in U.S. Pat. No. 6,346,315 might be employed to protect the frangible ceramic during transport or handling of the elements. The '615 patent describes house wares, including frangible ceramic dishes and drinking glasses coated with a protective plastic coating, usually including an initial adhesion-promoting silane, and a coating of urethane, such as a high temperature urethane to give protection to the underlying layers, and to the article, including protection within a commercial dishwasher. The silane combines with glass, and couples strongly with urethane. The urethane is highly receptive to decoration, which may be transferred or printed onto the urethane surface, and this may be useful to apply bar coding, patent numbers, trademarks, or other identifying information to plugs useful in invention. The high temperature urethane outer coating may be a thermosetting urethane, capable of withstanding temperatures as high as about 400° F. With the capability of selectively varying the respective thicknesses of the urethane coating/coatings, a range of desired characteristics, of resistance to chemicals, abrasion and impact for the plugs can be provided, as discussed in the '615 patent.

The flow-through passages may have a number of shapes, as long as the composition is able to plug it and subsequently be displaced therefrom. Suitable shapes include cylindrical, round, ovoid, rectangular, square, triangular, pentagonal, hexagonal, and the like. The flow-through passages may be in a random pattern or non-random pattern, such as a checker board pattern. The flow-through passages may be the same or different in shape and size from casing section to casing section.

Well operations include, but are not limited to, well stimulation operations, such as hydraulic fracturing, acidizing, acid fracturing, fracture acidizing, or any other well treatment, whether or not performed to restore or enhance the productivity of a well. Stimulation treatments fall into two main groups, hydraulic fracturing treatments and matrix treatments. Fracturing treatments are performed above the fracture pressure of the reservoir formation and create a highly conductive flow path between the reservoir and the wellbore. Matrix treatments are performed below the reservoir fracture pressure and generally are designed to restore the natural permeability of the reservoir following damage to the near-wellbore area.

Hydraulic fracturing, in the context of well workover and intervention operations, is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid keep the fracture open when the treatment is complete. Hydraulic fracturing creates high-conductivity communication with a large area of formation and bypasses any damage that may exist in the near-wellbore area.

In the context of well testing, hydraulic fracturing means the process of pumping into a closed wellbore with powerful hydraulic pumps to create enough downhole pressure to crack or fracture the formation. This allows injection of proppant into the formation, thereby creating a plane of high-permeability sand through which fluids can flow. The proppant remains in place once the hydraulic pressure is removed and therefore props open the fracture and enhances flow into the wellbore.

Acidizing means the pumping of acid into the wellbore to remove near-well formation damage and other damaging substances. This procedure commonly enhances production by increasing the effective well radius. When performed at pressures above the pressure required to fracture the formation, the procedure is often referred to as acid fracturing. Fracture acidizing is a procedure for production enhancement, in which acid, usually hydrochloric (HCl), is injected into a carbonate formation at a pressure above the formation-fracturing pressure. Flowing acid tends to etch the fracture faces in a nonuniform pattern, forming conductive channels that remain open without a propping agent after the fracture closes. The length of the etched fracture limits the effectiveness of an acid-fracture treatment. The fracture length depends on acid leakoff and acid spending. If acid fluid-loss characteristics are poor, excessive leakoff will terminate fracture extension. Similarly, if the acid spends too rapidly, the etched portion of the fracture will be too short. The major problem in fracture acidizing is the development of wormholes in the fracture face; these wormholes increase the reactive surface area and cause excessive leakoff and rapid spending of the acid. To some extent, this problem can be overcome by using inert fluid-loss additives to bridge wormholes or by using viscosified acids. Fracture acidizing is also called acid fracturing or acid-fracture treatment.

A "wellbore" may be any type of well, including, but not limited to, a producing well, a non-producing well, an injection well, a fluid disposal well, an experimental well, an exploratory well, and the like. Wellbores may be vertical, horizontal, deviated some angle between vertical and horizontal, and combinations thereof, for example a vertical well with a non-vertical component.

In summary, generally, this invention pertains to casing having a plurality of flow-through passages temporarily plugged with a composition, and methods of using such casing for treatment of a well, as described herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. §112, paragraph 6 unless "means for" is explicitly recited together with an associated function. "Means for" clauses are intended to cover the structures described herein as performing the recited function and not only structural equivalents, but also equivalent structures.

What is claimed is:

1. A method comprising:

(a) providing a plurality of flow-through passages in a portion of a casing while the casing is out of hole;

(b) temporarily plugging the flow-through passages with a composition, wherein the composition comprises an acid soluble material;

(c) running the casing in hole in a wellbore intersecting a hydrocarbon-bearing formation; and (d) exposing the composition to conditions sufficient to displace the composition from the flow-through passages while in hole.

2. The method of claim 1 wherein the composition further comprises at least one of member selected from the group consisting of organic materials, inorganic materials, and mixtures and reacted combinations thereof.

3. The method of claim 1 wherein the running in hole comprises running in hole a casing string comprising a plurality of casing sections joined together by the one or more casing joint sections.

4. The method of claim 3 wherein the exposing comprises dissolving the acid soluble material.

5. The method of claim 4 wherein the acid soluble material comprises aluminum.

6. The method of claim 4 wherein the acid soluble material comprises magnesium.

7. The method of claim 1 wherein the composition comprises aluminum or magnesium, and the exposing comprises deploying an acid solution from the surface in hole.

8. The method of claim 1 wherein the composition comprises aluminum or magnesium, and the exposing comprises spotting an acid solution using coiled tubing.

9. The method of claim 1 wherein the composition further comprises a polymer selected from acid-soluble polymers, basic-soluble polymers, and a water-soluble polymers.

10. The method of claim 1 wherein the exposing comprises pumping a fluid having, a specific, controlled pH and temperature into the well through the casing, exposing the composition in the plugged flow-through passages to the fluid and dissolving the composition.

11. The method of claim 1 further comprising treating the formation through the flow-through passages after the exposing.

12. The method of claim 11 further comprising subsequently plugging the flow-through passages, and wherein a portion of the flow-through passages are plugged with a second composition, the method further comprising exposing the second composition to conditions sufficient to degrade the second composition, and subsequently treating the formation a second time.

13. The method of claim 1 wherein the temporarily plugging the flow-through passages is conducted with a composition while out of hole.

14. The method of claim 1 as used in a diversion technique.

15. The method of claim 1 wherein the composition temporarily plugging the flow-through passages is in the form of a patch or plug.

16. A method comprising:

(a) providing a plurality of flow-through passages in a portion of a casing while the casing is out of hole;

(b) temporarily plugging the flow-through passages with an acid soluble material composition while out of hole;

(c) running the casing in hole in a wellbore intersecting a hydrocarbon-bearing formation;

(d) exposing the composition to conditions sufficient to displace the composition from the flow-through passages while in hole;

(e) treating the formation through the flow-through passages after the exposing step, and subsequently plugging the flow-through passages; and, (f) plugging a portion of the flow-through passages with a second composition, exposing the second composition to conditions sufficient to degrade the second composition, and subsequently treating the formation a second time.

17. The method of claim 16 further comprising:

(g) pumping a fluid having, a specific, controlled pH and temperature into the wellbore through the casing, and exposing the composition in the plugged flow-through passages to the fluid and degrading the composition; and, (h) treating the formation.

18. The method of claim 16 wherein the formation is treated through the flow-through passages after step (d).

19. The method of claim 16 wherein the flow through passages are plugged with an plug or patch, the plug or patch comprising aluminum or magnesium.

20. A method comprising:

(a) providing a casing;

(b) forming a plurality of flow-through passages in the casing sections while out of hole;

(c) temporarily plugging the flow-through passages with an acid soluble composition while out of hole, wherein the acid soluble composition comprises aluminum or magnesium;

(d) running the casing in hole in a wellbore intersecting a hydrocarbon-bearing formation; and (e) exposing the composition to conditions sufficient to displace the composition from the flow-through passages while in hole.

* * * * *